US006812650B2

(12) United States Patent
Yasuda et al.

(10) Patent No.: US 6,812,650 B2
(45) Date of Patent: Nov. 2, 2004

(54) ORGANIC EL DISPLAY DEVICE

(75) Inventors: Hitoshi Yasuda, Gifu (JP); Hidenori Chiba, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/405,038

(22) Filed: Apr. 2, 2003

(65) Prior Publication Data

US 2004/0012340 A1 Jan. 22, 2004

(30) Foreign Application Priority Data

Apr. 3, 2002 (JP) ..... 2002-101350

(51) Int. Cl.[7] ..... G09G 3/10

(52) U.S. Cl. ..... 315/169.1; 315/169.3; 345/76; 345/77

(58) Field of Search ..... 315/169.3, 169.1; 345/76, 77

(56) References Cited

U.S. PATENT DOCUMENTS 5,990,629 A * 11/1999 Yamada et al. ..... 315/169.3

6,366,025 B1 * 4/2002 Yamada ..... 315/169.3

* cited by examiner

*Primary Examiner*—David Vu

(74) *Attorney, Agent, or Firm*—Morrison & Foerster LLP

(57) ABSTRACT

An organic electroluminescent display device includes a plurality of electroluminescent elements and a plurality of thin film transistors. Each of the electroluminescent elements includes an anode, a cathode and a light emitting layer disposed between the anode and the cathode. Each of the thin film transistors drives one of the electroluminescent elements. A first power supply is connected to the thin film transistors and supplies a power supply voltage to the thin film transistors. The first power supply changes the power supply voltage so that luminance of the light emitting layers vary. A second power supply is connected to the electroluminescent elements and supplies a reference voltage to the electroluminescent elements. Because the power supply voltage itself varies, it is easy to adjust the brightness of the display device.

10 Claims, 9 Drawing Sheets

Prior Art

ORGANIC EL DISPLAY DEVICE

BACKGROUND OF THE INVENTION

1. Field of the Invention

This invention relates to an active-type organic electroluminescenct (EL) display device that includes thin-film transistors (TFTs) driving EL elements, and in particular, an active-type organic EL display device that provides an easy brightness adjustment.

2. Description of the Related Art

Since organic EL elements are self-luminous, they requires no back lights as required in liquid crystal display devices and are optimal for a reduction in thickness. Moreover, since-they have no limit in viewing angle, practical application thereof as a next-generation display device has been greatly expected.

In display devices using such organic EL elements, different luminescent materials for respective RGB three primary colors are used in corresponding light emitting layers, and are independently disposed corresponding pixels to directly emit respective RGB lights.

In such an organic EL display device, as shown in FIG. 1, RGB image signals are corrected by respective gamma correction circuits 71, 72, and 73 individually provided for the RGB signals. The gamma corrected signals are supplied to an organic EL panel 70 to display an image. Gamma correction converts the relationship where the output luminance level is proportional to the input signals to the power of gamma into the relationship where the output luminance is linearly proportional to input signals.

In FIG. 2, luminance characteristics of respective RGB light emitting layers are shown on the left side, the characteristics between the input gradation and luminance corrected by the gamma correction circuits 71, 72, and 73 are shown on the right side. Namely, in order to maintain white balance, luminance ratio of RGB is determined in an order of GBR, and gamma correction is carried out by the respective RGB gamma correction circuits 71, 72, and 73 so that RGB luminance vary linearly to allow a 64-gradation display.

Since R is driven with a luminance between Rmin and Rmax, it is sufficient to adjust a 64-gradation voltage within a range ΔR shown by arrows for a voltage applied to the R light emitting layer. Since G is also driven with a luminance between Gmin and Gmax, it is sufficient to adjust a 64-gradation voltage within a range ΔG shown by arrows for a voltage applied to the G light emitting layer. Similarly, since B is also driven with a luminance between Bmin and Bmax, it is sufficient to adjust a 64-gradation voltage within a range ΔB shown by arrows for a voltage applied to the B light emitting layer.

However, in the aforementioned organic EL display device, although an adjustment in luminance of the respective light emitting layers is possible for a 64-gradation display within the ranges of RGB image signals, the total luminance of the organic EL display device cannot be controlled to reflect the surrounding environment conditions. In particular, the whole image can not be made brighter in an environment of daytime outdoor use, or the whole image can be made darker in an environment of nighttime indoor use.

In addition, in the aforementioned organic EL display device, as shown in FIG. 2, since the luminance setting ranges of the respective RGB light emitting layers, namely, the range ΔR, the range ΔG and the range ΔB, are different, the output dynamic range of an IC that outputs image signals cannot cover all of the ranges ΔR, ΔG and ΔB. In particular, the high range of ΔB exceeds the output dynamic range. Accordingly, the luminance cannot be effectively controlled in response to the image signals in the B light emitting layer.

SUMMARY OF THE INVENTION

The invention provides an organic electroluminescent display device that includes a plurality of electroluminescent elements. Each of the electroluminescent elements includes an anode, a cathode and a light emitting layer disposed between the anode and the cathode. The device also includes a plurality of thin film transistors. Each of the thin film transistors drives one of the electroluminescent elements. A first power supply is connected to the thin film transistors and supplies a power supply voltage to the thin film transistors. The first power supply changes the power supply voltage so that luminance of the light emitting layers vary. A second power supply is connected to the electroluminescent elements and supplies a reference voltage to the electroluminescent elements.

The invention also provides an organic electroluminescent display device that includes, for each of red, green and blue emissions, a plurality of electroluminescent elements for corresponding light emission. Each of the electroluminescent elements includes an anode, a cathode and a light emitting layer disposed between the anode and the cathode. The device also includes a plurality of thin film transistors, each of which drives one of the electroluminescent elements. The device includes, for each of red, green and blue emissions, a power supply connected to the thin film transistors for supplying a power supply voltage. The power supply changes the power supply voltage so that luminance of the corresponding light emitting layers vary. The device also includes a reference voltage supply connected to the electroluminescent elements for supplying a reference voltage.

The invention further provides an organic electroluminescent display device that includes a plurality of electroluminescent elements. Each of the electroluminescent elements includes an anode, a cathode and a light emitting layer disposed between the anode and the cathode. The device also includes a plurality of thin film transistors and a sensor. Each of the thin film transistors drives one of the electroluminescent elements. A first power supply is connected to the thin film transistors and supplies a power supply voltage to the thin film transistors. The first power supply changes the power supply voltage in response to an output of the sensor. A second power supply is connected to the electroluminescent elements and supplies a reference voltage to the electroluminescent elements.

The invention also provides an organic electroluminescent display device that includes, for each of red, green and blue emissions, a plurality of electroluminescent elements for corresponding light emission. Each of the electroluminescent elements includes an anode, a cathode and a light emitting layer disposed between the anode and the cathode. The device also includes a plurality of thin film transistors and a sensor. Each of the transistors drives one of the electroluminescent elements. The device includes, for each of red, green and blue emissions, a power supply connected to the thin film transistors for supplying a power supply voltage. The power supply changes the power supply voltage in response to an output of the sensor. The device also includes a reference voltage supply connected to the electroluminescent elements for supplying a reference voltage.

DETAILED DESCRIPTION OF THE INVENTION

Figure 3:
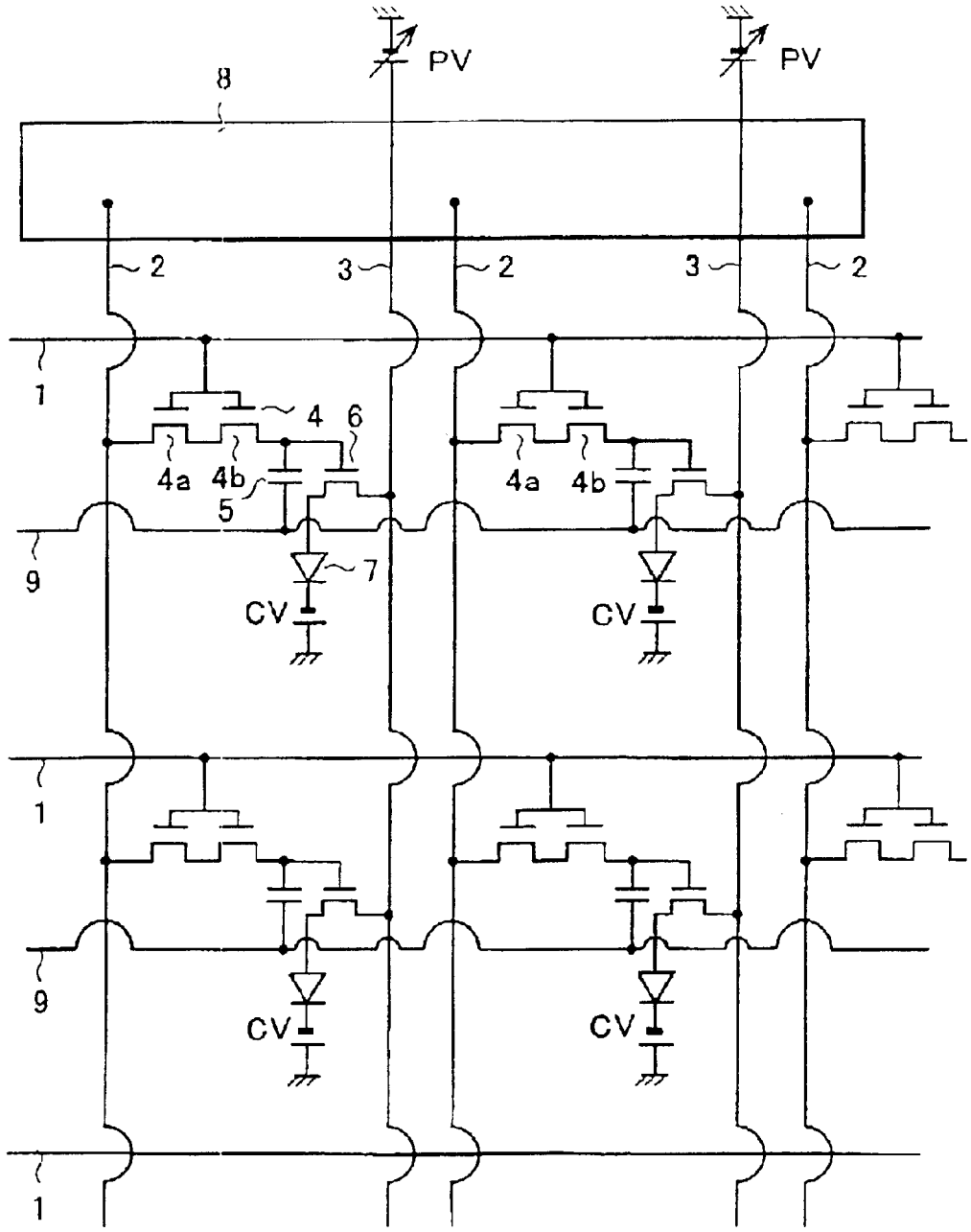
FIG. 3 is an equivalent circuit diagram of an organic EL display device of a first embodiment of the invention.

An organic EL display device of a first embodiment of this invention will be described with reference to FIGS. 3–10. An equivalent circuit diagram of the organic EL display device of the first embodiment is shown in FIG. 3.

A plurality of gate lines 1 extend in the row direction, and a plurality of data lines 2 and driving lines 3 extend in the column direction. The driving lines 3 are connected to power supplies PVs. The power supplies PV provides a variable voltage, which changes in response to an output of a sensor, a switch or the like.

Switching TFTs 4 are connected to respective intersections between the gate lines 1 and data lines 2. The switching TFTs 4 each have a double gate structure in which two TFTs 4*a* and 4*b* are connected in series, and gates of the respective TFTs 4*a* and 4*b* of the switching TFT 4 are connected to the gate line 1, and a drain of the switching TFT 4*a* is connected to the data line 2. A source of the switching TFT 4*b* is connected to a retaining capacitor 5 and a gate of a driving TFT 6.

A drain of the driving TFT 6 is connected to the driving line 3, and a source thereof is connected to an anode of an organic EL element 7. A cathode of the organic EL element 7 is connected to a power supply CV. The power supply CV outputs a negative constant voltage. However, this voltage may be zero or a positive voltage as long as it serves a reference voltage of the display device. A capacitance line 9 that extends in the column direction 9 is connected to the counter electrode of the retaining capacitor 5.

The gate lines 1 are connected to a gate line driver (not shown), and receives gate signals from the gate line driver. A gate signal is a binary signal of ON or OFF. "ON" signal is a positive predetermined voltage, and "OFF" signal is 0 volt. The gate line driver turns on a gate signal of a designated gate line selected out of the plurality of connected gate lines 1. When the gate signal is turned on, TFTs of all selective transistors 4 connected to this gate line 1 are turned on, and the data lines 2 and gates of the driving transistors 6 are connected via the selective transistors 4.

Data signals corresponding to an image to be displayed are outputted from the data line driver 8 to the date line. The data signals are inputted into the gate of the driving transistor 6 and are stored in the retaining capacitor 5.

The driving transistor 6 connects the driving line 3 and the organic EL element 7 at a conductivity corresponding to the data signals. As a result, an electric current in response to the data signals is supplied from the driving line 3 to the organic EL element 7 via the driving transistor 6, and the organic EL element 7 emits light at a luminance according to the data signals.

The retaining capacitor 5 forms a capacitance in connection with its dedicated capacitance line 9 or another electrode such as a driving line 3, and can accumulate the data signals for a definite period of time.

The data signals are retained for a period of one-time vertical scanning by the retaining capacitor 5 after the gate line driver selects another gate line 1. The gate line 1 first selected becomes unselected, and the selective transistors 4 are turned off. During this period, the driving transistor 6 retains the above conductivity, and the organic EL element 7 can continue emitting light at that luminance.

The above is a principle of operation of an active matrix-type organic EL display device. However, may modifications are possible to the device configuration described above.

Figure 4:
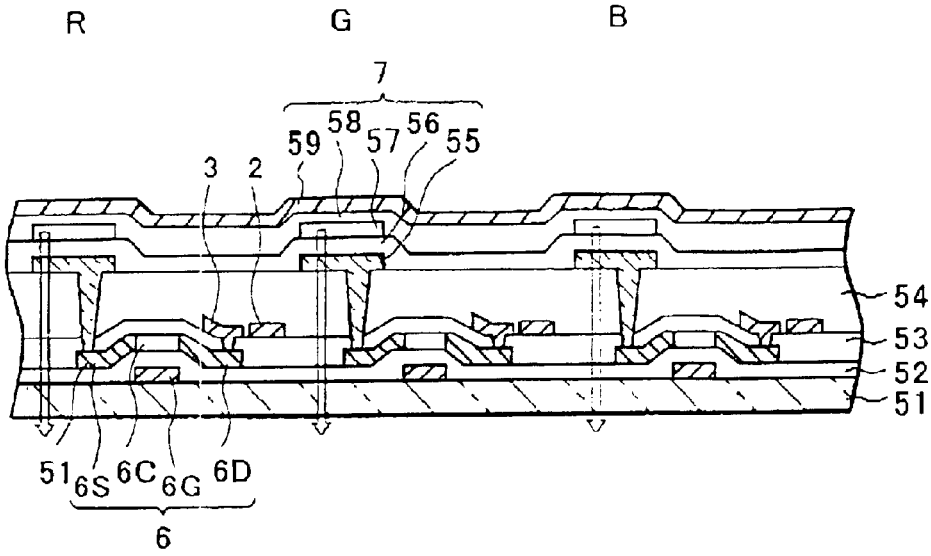
FIG. 4 is a sectional view of the organic EL display device of FIG. 3.

FIG. 4 is a sectional view of an active matrix-type organic EL display device. A plurality of driving TFTs 6 are arranged on a glass substrate 51. The driving TFTs 6 each have a structure wherein a gate electrode 6G is opposed to a source 6S, a channel 6C, and a drain 6D via an interlayer insulation film 52. The structure of FIG. 4 is a bottom gate structure in which a gate electrode 6G is lower than the channel 6C.

An interlayer insulation film 53 is formed on the driving TFT 6, on which a data line 2 and a driving line 3 are arranged. The driving line 3 is connected to the drain 6D of the driving TFT 6 via a contact. A flattening insulation film 54 is formed on the driving line 3, and on the flattening insulation film 54, an organic EL element 7 is arranged for each pixel.

The organic EL element 7 includes an anode 55 made of a transparent electrode such as ITO (indium tin oxide), a hole transporting layer 56, a light emitting layer 57, an electron transport layer 58, and a cathode 59 made of metal such as aluminum. Holes injected from the anode 55 into the hole transporting layer 56 and electrons injected from the cathode 59 into the electron transport layer 58 are recombined inside the light emitting layer 57 to emit light. This light is, as shown by arrows in the drawing, released through the transparent anode 55 and the glass substrate 51 to the outside. The anode 55 and light emitting layer 57 are independently formed for each pixel, and the hole transporting layer 56, electron transport layer 58, and cathode 59 are formed in common among respective pixels.

Figure 5:
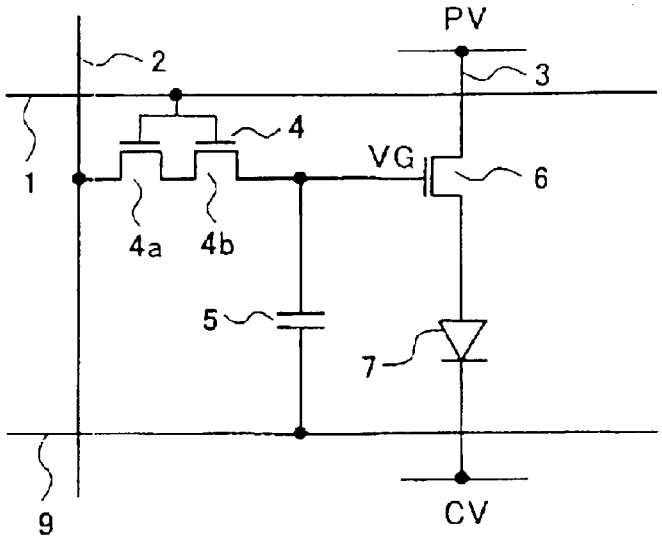
FIG. 5 is a circuit diagram corresponding to one pixel of the organic EL display device of FIG. 3.

FIG. 5 is a circuit diagram showing a power supply PV, a driving TFT 6, an EL element 7, and a power supply CV of one pixel in a manner extracted from the circuit diagram shown in FIG. 3. As shown in the drawing, the driving TFT 6 and the organic EL element 7 are connected in series between the positive power supply PV and negative power supply CV. A drive current that flows into the organic EL element 7 is supplied from the power supply PV to the organic EL element 7 via the driving transistor 6, and this drive current is controlled by changing a gate voltage VG of the driving transistor 6. As described above, since the data signals are inputted in the gate electrode, the gate voltage VG is a voltage corresponding to the data signals.

Figure 6:
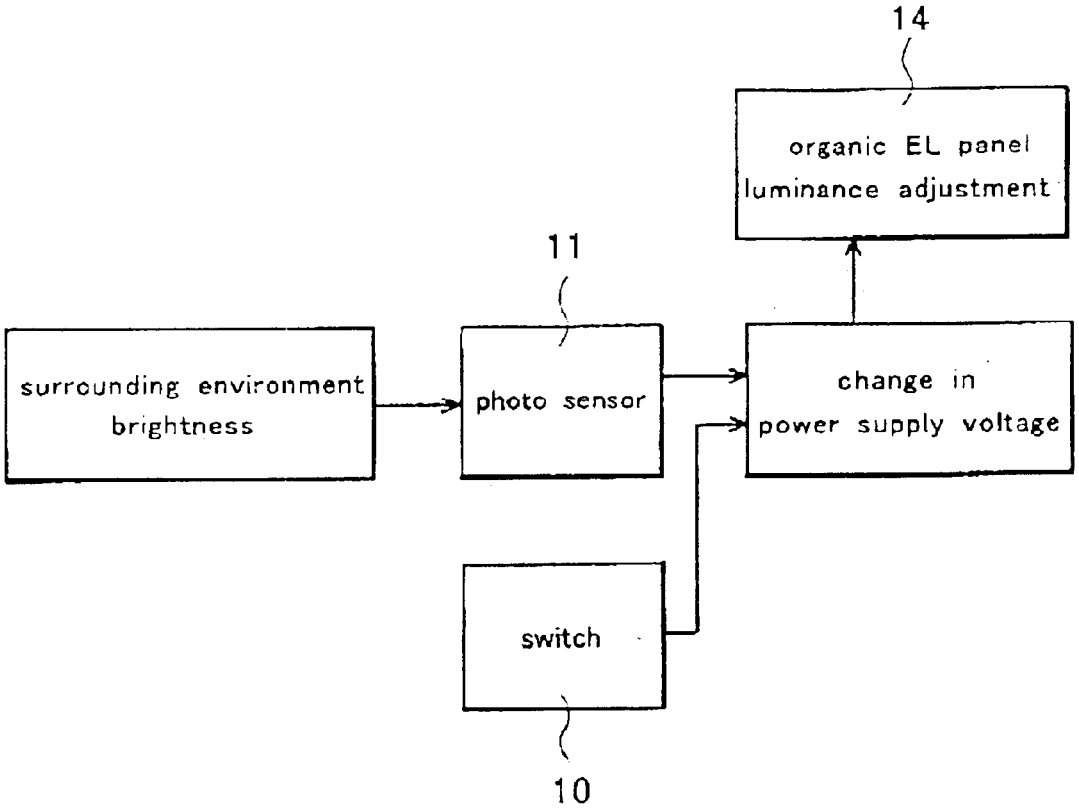
FIG. 6 is a block diagram of the organic EL display device of the first embodiment.

FIG. 6 is a block diagram for explaining an organic EL display device of this embodiment. A feature of this embodiment is that the luminance of all EL elements of the organic EL display device is adjusted simultaneously by changing the power supply voltage of the power supply PV. This feature enables a user of the display device to adjust the brightness of the display device easily. For example, a simple operation on a switch by the user changes the total luminance of the EL elements. Coupled with a photo sensor, this feature is used to automatically adjust the total luminance of the EL elements. Thereby, the whole image is made brighter by raising the power supply voltage to drive the EL elements, and the whole image is made darker by reducing the voltage.

Figure 7:
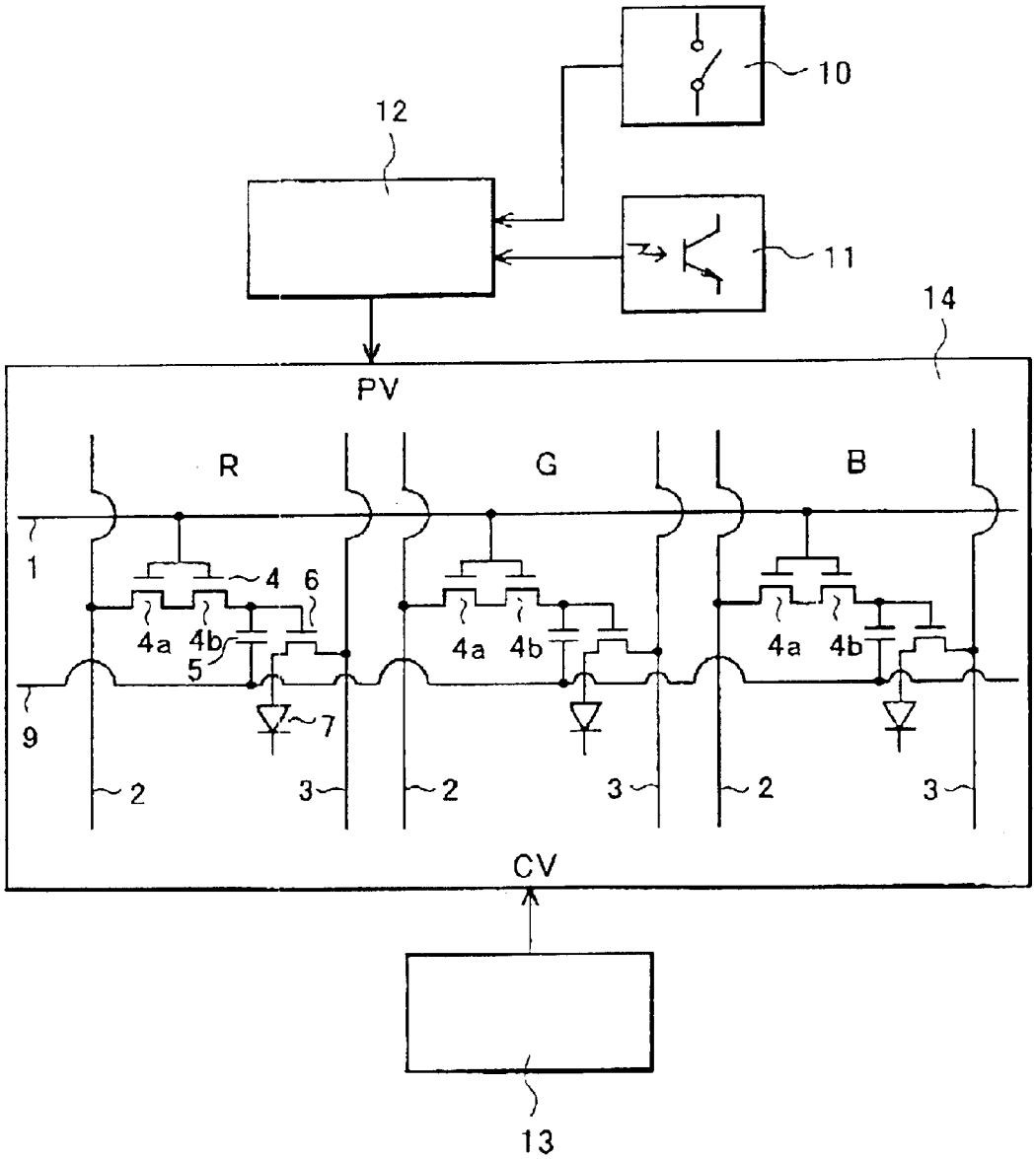
FIG. 7 is a block diagram including a switch and sensor of the organic EL display device of the first embodiment.

FIG. 7 is a block diagram of the EL display device of this embodiment including.

The display device includes a switch 10, a photo sensor 11, a first power supply 12, which is the same as the power source PV in FIG. 3, to supply a variable positive power supply voltage, a second power supply 13, which is the same as the power source CV in FIG. 4, to supply a negative constant power supply voltage, and an organic EL panel 14.

The switch 10 is a touch switch or the like, which can choose approximately three brightness levels, i.e., bright, normal and dark. The photo sensor 11 is a phototransistor, a photodiode, or the like, which is an element to allow an electric current flow in proportion to the brightness.

The first power supply 12 and the second power supply 13 both include a DC/DC converter. The positive power supply voltage of the first power supply 12 can be changed by a detection output from the photo sensor 11, while the negative power supply voltage of the second power supply 12 is fixed. These power supplies 12, 13 respectively supply the power supply voltages to a first power supply PV terminal and a second power supply CV terminal of the organic EL panel 14.

Figure 8:
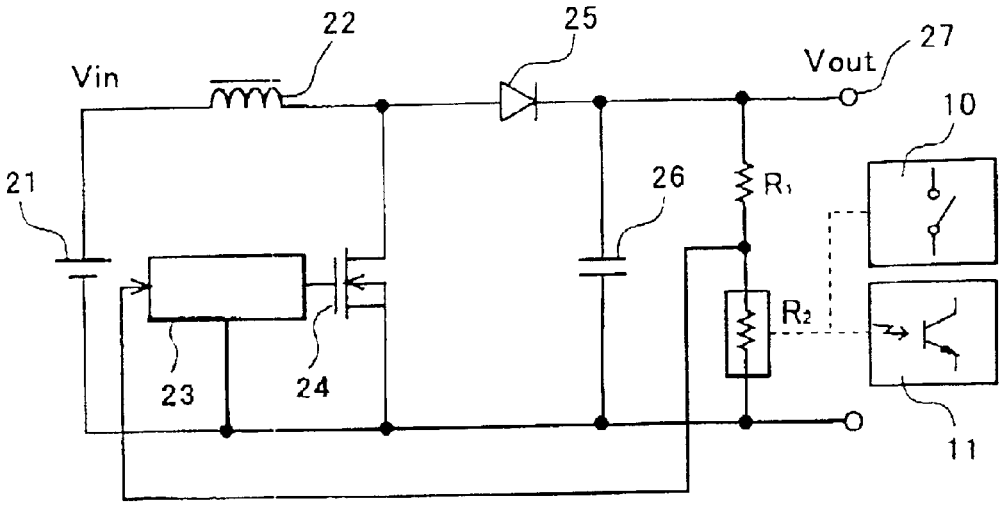
FIG. 8 is an equivalent circuit diagram of a power-supply circuit of the organic EL display device of the first embodiment.

FIG. 8 shows an equivalent circuit diagram of the power supply 12 of this embodiment. As shown in FIG. 8, the DC—DC converter of the first power supply 12 includes an inductor 22, a pulse width modulation circuit 23, a MOSFET 24, a diode 25, a capacitor 26 and an output terminal 27. A direct current voltage Vin from the direct current power supply 21 is connected to a drain of the MOSFET 24 and an anode of the diode 25 via the inductor 22, and an output voltage is outputted from a cathode of the diode 25 to one end of the capacitor 26. In addition, the pulse width modulation circuit 23 is connected to a gate of the MOSFET 24 and turns on and off the MOSFET 24 at a predetermined cycle with a variable pulse width.

In this embodiment, resistor R1 and variable resistor R2, resistance of which is adjusted by an input voltage, are connected to the output terminal 27 in series. An IC-based variable resistor, know as an electron volume in the art, may be used as the variable resistor R2 of this embodiment. A detection voltage divided by these resistors is fed back to the pulse width modulation circuit 23.

When the switch 10 is used, the resistance of resistor R2 is adjusted in response to a signal from the switch 10. In addition, in order to accommodate the change in brightness of the surrounding environment, based on a detection output from the photo sensor 11, if the surrounding environment is dark, the resistance of resistor R2 is increased. If the surrounding environment is bright, the resistance of resistor R2 is decreased. In short, the resistance of resistor R2 varies in response to the photoelectric current that is supplied to the resistor R2 from the photo sensor 11.

Next, the operation of the DC—DC converter will be described. When a pulse from the pulse width modulation circuit 23 is applied to a gate of the MOSFET 24, the MOSFET 24 is turned on, and an electric current flows between the drain and source. Due to this electric current, electric energy is charged in the inductor 22. When the MOSFET 24 is subsequently turned off, a reverse electromotive force occurs in the inductor 22. This reverse electromotive force acts to add additional voltage to the direct current voltage of the direct current power supply 21. The increased output voltage Vout is stored in the capacitor 26 via the diode 25. The output voltage from this capacitor 26 is, when the MOSFET 24 is turned on, supplied to the organic EL panel 14 via the output terminal 27, whereby the organic EL panel 14 is driven.

In this embodiment, the detection voltage divided by resistor R1 and resistor R2 is fed back to the pulse width modulation circuit 23. The pulse width is controlled by comparing this detection voltage with a reference triangle wave by a comparator provided in the pulse width modulation circuit 23. The pulse width is decreased if the detection voltage is increased, and feedback is carried out so as to lower the output voltage. On the other hand, the pulse width is increased if the detection voltage is decreased, and feedback is carried out so as to raise the output voltage.

Accordingly, when the switch 10 is used, the resistance of resistor R2 is reduced if, for example, the switch is at the "bright" position, whereby the detection voltage divided by resistor R1 and resistor R2 is reduced. As a result, the output voltage from the DC—DC converter rises, and if the switch is at the "dark" position, the output voltage falls.

Figure 9:
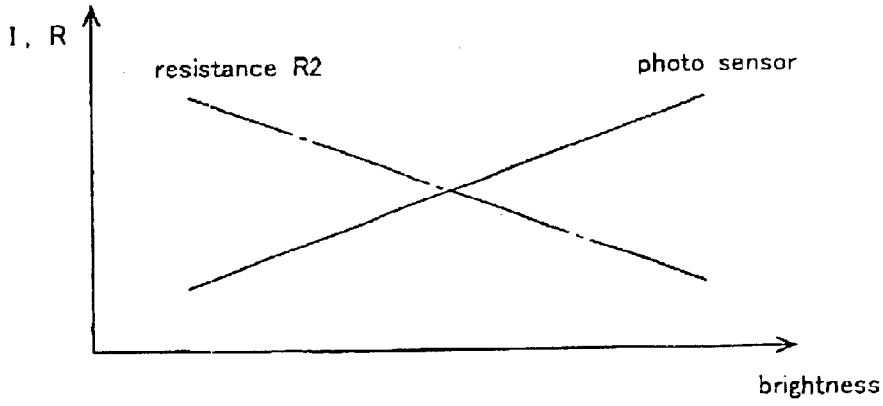
FIG. 9 is a characteristic diagram of the power-supply circuit of FIG. 8.

In addition, in order to accommodate the change in brightness of the surrounding environment, a photo current-resistance relationship is as shown in FIG. 9. When it becomes bright, the photo electric current of the photo sensor 11 increases, and the resistance is reduced. Therefore, since the resistance of resistor R2 is reduced, the detection voltage divided by resistor R1 and resistor R2 is decreased. As a result, the output voltage from the DC—DC converter rises when it becomes bright, and falls when it becomes dark.

Since the aforementioned DC—DC converter is used as the first power supply 12 in this embodiment, the positive power supply voltage is applied from the first power supply PV to the source of the driving TFT 6 via the driving line 3. Since the output voltage from the DC—DC converter rises when the detection voltage is reduced, the gate-to-source voltage of the driving TFT 6 deepens and the electric current that flows in the driving TFT 6 is increased.

Figure 10:
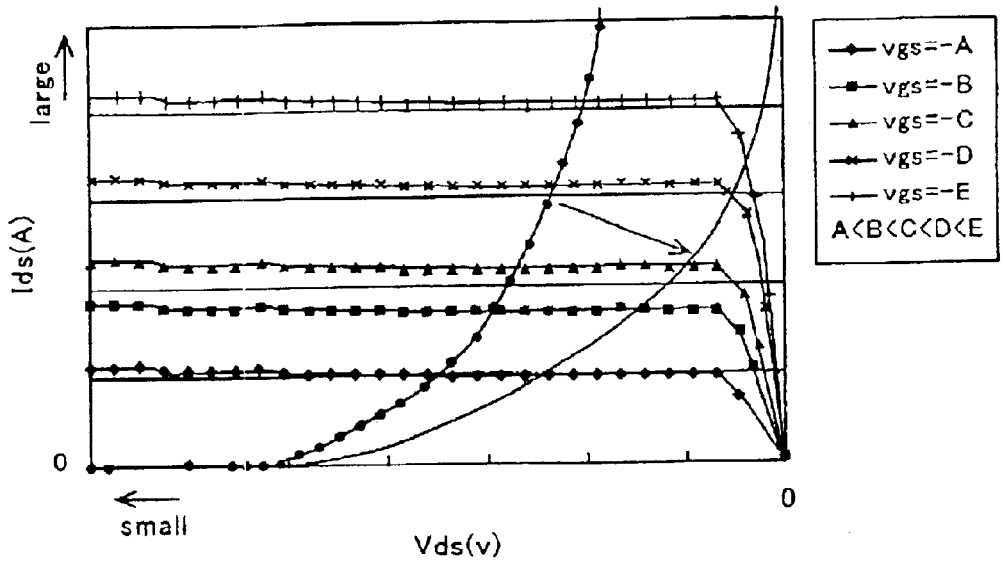
FIG. 10 shows the source-drain current flow as a function of source-drain voltage and source-gate voltage.

A Vds-Ids relationship of the driving TFT 6 is shown in FIG. 10. As is clear from this drawing, Ids increases as the gate-source voltage Vgs deepens. Accordingly, the electric current that flows in the organic EL element 7 connected to the drain of the driving TFT 6 increases when the detection voltage is reduced, whereby luminance thereof is raised. On the other hand, when the detection voltage is increased, the electric current that flows in the organic EL element 7 is decreased, whereby luminance thereof is lowered. In the drawing, two lines intersecting the horizontal lines represent V–I characteristics of the organic EL element 7. The one on the left corresponds to the characteristic when the organic EL element 7 is placed in a bright environment, and the one on the right corresponds to the characteristic when the organic EL element 7 is placed in a dark environment. The characteristic line shifts from the left to right depending on the brightness in which the organic EL element 7 is placed. The display device utilizes the V–I characteristics to change the current running in the organic El element 7 in order to adjust the brightness of the environment.

Figure 11:
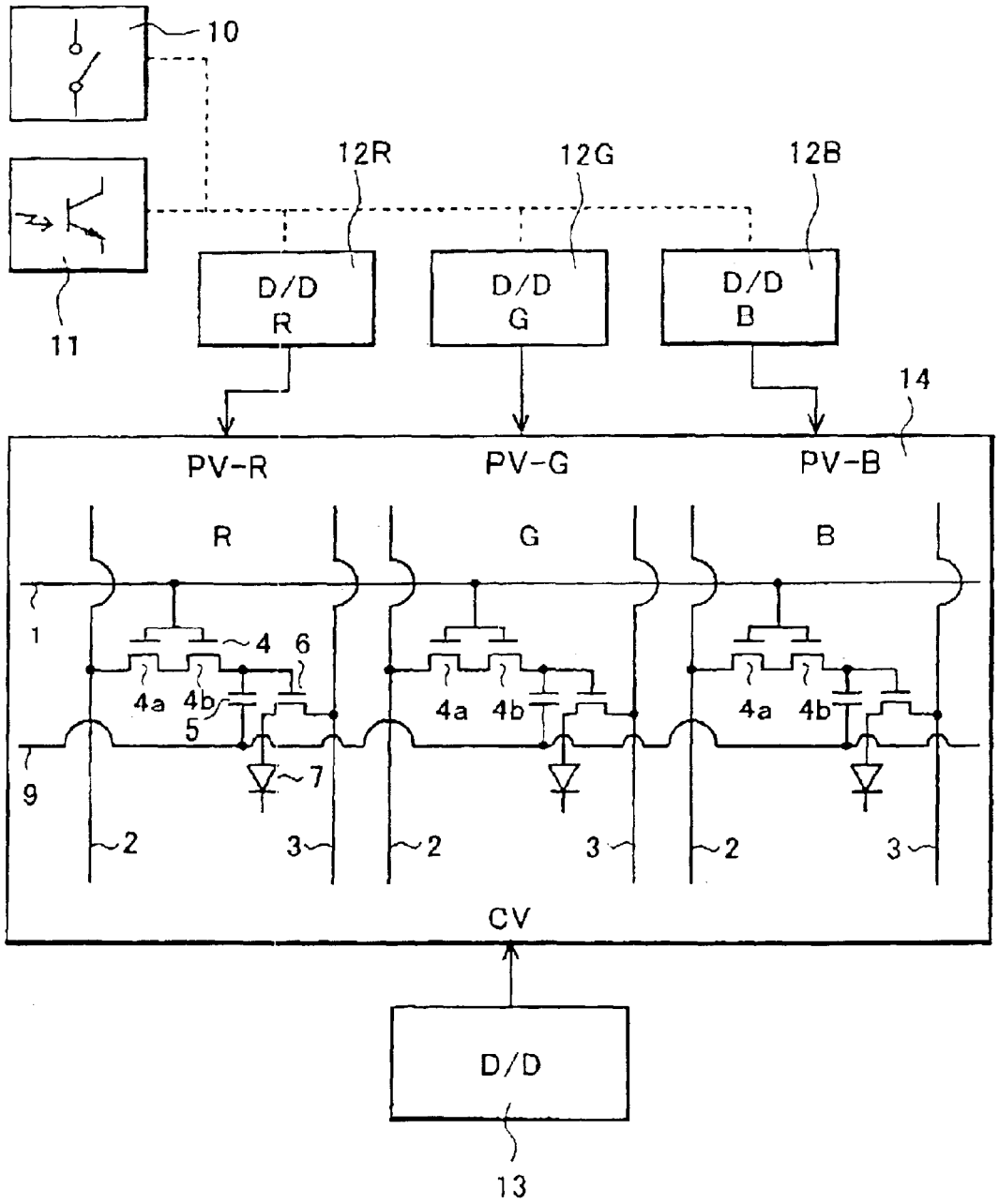
FIG. 11 is a block diagram of an organic EL display device of a second embodiment of the invention.

FIG. 11 shows a block diagram of an organic EL display device of a second embodiment of the invention. In this configuration, the DC/DC converter of the first power supply PV of the first embodiment is provided for each of RGB organic EL elements 7, corresponding to red, green and blue light emission. The switch 10 or a photo sensor 11 is provided in common for the RGB EL elements, and first power supplies 12R, 12G, and 12B are provided for RGB organic EL elements 7, respectively. The second power supply 13 is provided in common.

Since the organic EL elements 7 using different luminescent materials in respective RGB light emitting layers have luminous efficiencies, lifetimes, and threshold values which are different among respective RGB, if a change in power supply voltage of the DC/DC converter is designed considering the respective characteristics in the first light sources 12R, 12G, and 12B, a luminance adjustment of the whole image can be carried out without losing color balance.

Figure 1:
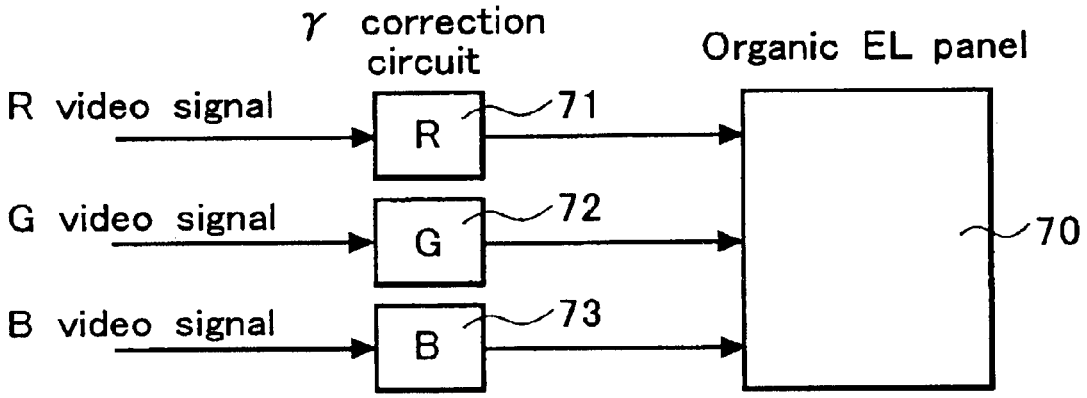
FIG. 1 is a block diagram of a conventional organic EL display device.
Figure 2:
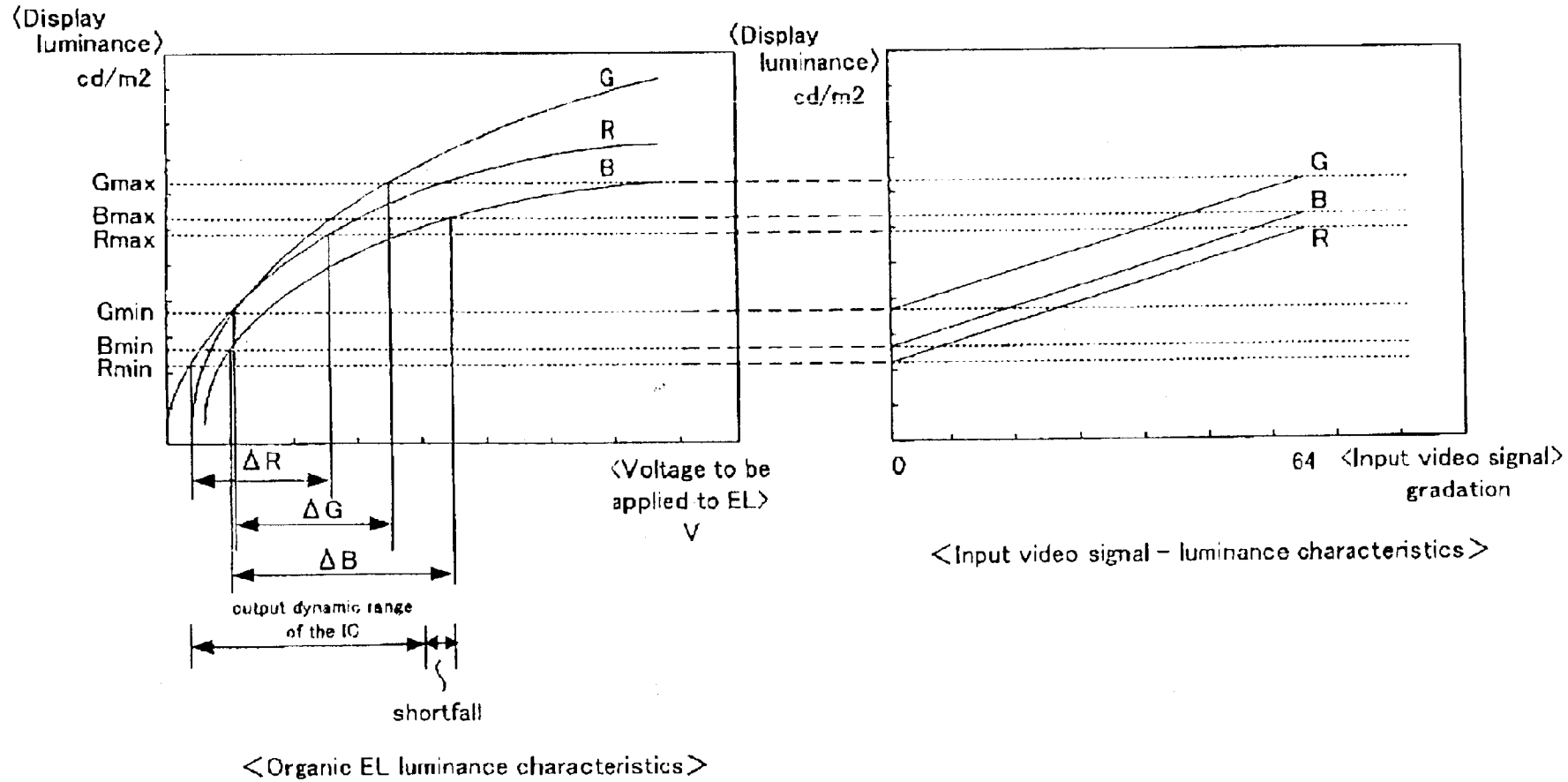
FIG. 2 is a luminance characteristic diagram of the conventional organic EL display as well as organic EL display device of the embodiments of the invention.

In addition, as shown on the left side of FIG. 2, since the luminance setting ranges of the respective RGB light emitting layers, namely, the range ΔR, the range ΔG, and the range ΔB are different, the power supply voltage of the DC/DC converter can be changed in the first power supplies 12R, 12G, and 12B considering, for example, the respective luminance setting ranges as follows.

Since the luminance setting ranges of the R and G light emitting layers, namely, the range ΔR and the range ΔG, are relatively narrow, the output dynamic range of the IC that outputs image signals can cover the luminance setting ranges without changing the power supply voltages of the first power supply 12R and 12G On the other hand, since the luminance setting range of the B light emitting layer, namely, the range ΔB, is at a high application voltage side, if the power supply voltage of the DC/DC converter of the first light supply 12B is shifted to the high voltage side, this shift practically assures that the output dynamic range of the IC is offset by the shifted amount of voltage. This range ΔB can be covered without altering the output dynamic range of the IC.

Accordingly, by individually shifting the first power supplies 12R, 12Q and 12B, luminance setting ranges of the respective RGB light emitting layers can be covered without altering the output dynamic range of the IC, and the luminance setting ranges of the respective RGB light emitting layers can also be expanded.

If the materials used for the light emitting layers are modified or replaced by other materials, the scheme for covering the luminance setting ranges should be modified accordingly. For example, it may required to shift the power supply voltages of the all three DC—DC converters.

What is claimed is:

1. An organic electroluminescent display device comprising:

a plurality of electroluminescent elements, each of the electroluminescent elements comprising an anode, a cathode and a light emitting layer disposed between the anode and the cathode;

a plurality of thin film transistors, each of the thin film transistors driving a corresponding one of the electroluminescent elements;

a first power supply connected to the thin film transistors and supplying a power supply voltage to the thin film transistors, the first power supply changing the power supply voltage so that luminance of the light emitting layers vary; and a second power supply connected to the electroluminescent elements and supplying a reference voltage to the electroluminescent elements.

2. The organic electroluminescent display device of claim 1, wherein the first power supply comprises a DC—DC converter, and the DC—DC converter changes the power supply voltage in response to a feedback voltage.

3. An organic electroluminescent display device comprising:

a plurality of electroluminescent elements for red light emission, each of the electroluminescent elements for red light emission comprising an anode, a cathode and a red light emitting layer disposed between the anode and the cathode of the electroluminescent element for red light emission;

a plurality of electroluminescent elements for green light emission, each of the electroluminescent elements for green light emission comprising an anode, a cathode and a green light emitting layer disposed between the anode and the cathode of the electroluminescent element for green light emission;

a plurality of electroluminescent elements for blue light emission, each of the electroluminescent elements for blue light emission comprising an anode, a cathode and a blue light emitting layer disposed between the anode and the cathode of the electroluminescent element for blue light emission;

a plurality of thin film transistors, each of the thin film transistors driving a corresponding one of the electroluminescent elements;

a first power supply connected to the thin film transistors driving the electroluminescent elements for red light emission for supplying a first power supply voltage, the first power supply changing the first power supply voltage so that luminance of the red light emitting layers vary;

a second power supply connected to the thin film transistors driving the electroluminescent elements for green light emission for supplying a second power supply voltage, the second power supply changing the second power supply voltage so that luminance of the green light emitting layers vary;

a third power supply connected to the thin film transistors driving the electroluminescent elements for blue light emission for supplying a third power supply voltage, the third power supply changing the third power supply voltage so that luminance of the blue light emitting layers vary; and a reference voltage supply connected to the electroluminescent elements for red light emission, the electroluminescent elements for green light emission and the electroluminescent elements for blue light emission for supplying a reference voltage.

4. The organic electroluminescent display device of claim 2, wherein each of the first, second and third power supplies comprises a DC—DC converter, and the DC—DC converter changes the corresponding power supply voltage in response to a feedback voltage.

5. An organic electroluminescent display device comprising:

a plurality of electroluminescent elements, each of the electroluminescent elements comprising an anode, a cathode and a light emitting layer disposed between the anode and the cathode;

a plurality of thin film transistors, each of the thin film transistors driving a corresponding one of the electroluminescent elements;

a sensor;

a first power supply connected to the thin film transistors and supplying a power supply voltage to the thin film transistors, the first power supply changing the power supply voltage in response to an output of the sensor; and a second power supply connected to the electroluminescent elements and supplying a reference voltage to the electroluminescent elements.

6. The organic electroluminescent display device of claim 5, wherein the sensor comprises a photo sensor that detects brightness and changes the output based on the detected brightness.

7. The organic electroluminescent display device of claim 5, wherein the first power supply comprises a DC—DC converter, and the DC—DC converter changes the power supply voltage in response to a feedback voltage.

8. An organic electroluminescent display device comprising:

a plurality of electroluminescent elements for red light emission, each of the electroluminescent elements for red light emission comprising an anode, a cathode and a red light emitting layer disposed between the anode and the cathode of the electroluminescent element for red light emission;

a plurality of electroluminescent elements for green light emission, each of the electroluminescent elements for green light emission comprising an anode, a cathode and a green light emitting layer disposed between the anode and the cathode of the electroluminescent element for green light emission;

a plurality of electroluminescent elements for blue light emission, each of the electroluminescent elements for blue light emission comprising an anode, a cathode and a blue light emitting layer disposed between the anode and the cathode of the electroluminescent element for blue light emission;

a plurality of thin film transistors, each of the thin film transistors driving a corresponding one of the electroluminescent elements;

a sensor;

a first power supply connected to the thin film transistors driving the electroluminescent elements for red light emission for supplying a first power supply voltage, the first power supply changing the first power supply voltage in response to an output of the sensor;

a second power supply connected to the thin film transistors driving the electroluminescent elements for green light emission for supplying a second power supply voltage, the second power supply changing the second power supply voltage in response to the output of the sensor;

a third power supply connected to the thin film transistors driving the electroluminescent elements for blue light emission for supplying a third power supply voltage, the third power supply changing the third power supply voltage in response to the output of the sensor; and a reference voltage supply connected to the electroluminescent elements for red light emission, the electroluminescent elements for green light emission and the electroluminescent elements for blue light emission for supplying a reference voltage.

9. The organic electroluminescent display device of claim 8, wherein the sensor comprises a photo sensor that detects brightness and changes the output based on the detected brightness.

10. The organic electroluminescent display device of claim 8, wherein each of the first, second and third power supplies comprises a DC—DC converter, and the DC—DC converter changes the corresponding power supply voltage in response to a feedback voltage.

* * * * *